US007967112B2

(12) United States Patent
Kaplan et al.

(10) Patent No.: US 7,967,112 B2
(45) Date of Patent: Jun. 28, 2011

(54) CHECK STAND WITH A TWO BELTED INPUT AND A SLIDABLE SCANNER

(75) Inventors: Eric Kaplan, Lilburn, GA (US); Michael S. Notheis, Hoschton, GA (US)

(73) Assignee: Royston, LLC., Jasper, GA (US)

( * ) Notice: Subject to any disclaimer, the term of this patent is extended or adjusted under 35 U.S.C. 154(b) by 212 days.

(21) Appl. No.: 11/949,160

(22) Filed: Dec. 3, 2007

(65) Prior Publication Data

US 2008/0302607 A1 Dec. 11, 2008

Related U.S. Application Data

(60) Provisional application No. 60/868,335, filed on Dec. 2, 2006, provisional application No. 60/868,795, filed on Dec. 6, 2006.

(51) Int. Cl.
*A47F 9/04* (2006.01)

(52) U.S. Cl. ..... 186/59; 186/60; 186/61; 186/67; 198/368

(58) Field of Classification Search ..... 186/59, 186/60, 61, 67, 68, 69; 198/444, 451, 571, 198/572, 358, 368, 348, 355, 363
See application file for complete search history.

(56) References Cited

U.S. PATENT DOCUMENTS

| | | | | | |
|---|---|---|---|---|---|
| 2,493,464 | A | * | 1/1950 | Nelson | 198/454 |
| 2,569,711 | A | * | 10/1951 | Foster | 186/68 |
| 2,678,124 | A | * | 5/1954 | Bergmann | 198/444 |
| 3,075,616 | A | * | 1/1963 | Shofiner | 186/66 |
| 4,114,727 | A | | 9/1978 | Joseloff | |
| 4,392,553 | A | | 7/1983 | Foster | |
| 4,401,189 | A | * | 8/1983 | Majewski | 186/68 |
| 4,953,664 | A | * | 9/1990 | Vrooman et al. | 186/59 |
| 5,178,234 | A | | 1/1993 | Sakurai et al. | |
| 5,311,969 | A | * | 5/1994 | Dickover et al. | 186/61 |
| 5,375,680 | A | | 12/1994 | Ikeda et al. | |
| 5,390,764 | A | * | 2/1995 | Kerber | 186/68 |

(Continued)

FOREIGN PATENT DOCUMENTS

| | | |
|---|---|---|
| DE | 19904599 | 8/2000 |

(Continued)

*Primary Examiner* — Jeffrey A. Shapiro
*Assistant Examiner* — Mark J Beauchaine
(74) *Attorney, Agent, or Firm* — Thomas, Kayden, Horstemeyer & Risley, LLP.

(57) ABSTRACT

This invention provides a high-volume check stand with a front transport that has two belted input conveyors so that a customer can load one belt while the cashier is checking out products purchased by a second customer on the second belt. This two belt module has a flush rear end to which is attached a scanner that can be slid from one belt to the other. Preferably this check stand has an output module which has two belts and two rollers so that the check stand can use a bagger on each side for bagging the items, to speed checkout time. Embodiments of this check stand may have an output module that is a carousel or a turntable. It could also have any combination of one or two conveyor belts and one or two rollers on an incline for use in packing the products. A scanner is placed between the flush rear end of the front transport and the flush front end of the output module. The scanner has means for either being slid transversely or rotated by the cashier between one belted conveyor and the other conveyer so that the cashier can move from scanning products on one conveyor to the other.

2 Claims, 10 Drawing Sheets

Front Module: Flush End
Scanner Module: Rotating Scanner
Rear Module:
*Order Processing Division:* Concurrent Orders with Flush End
*Product Transport*: Belted Conveyor
*Bag Rack Configuration*: In-Line Bagging
*Bag Rack Mounting*: Fixed Bag Racks
Other Features: Monitor Mounting

U.S. PATENT DOCUMENTS

| | | | | |
|---|---|---|---|---|
| 5,492,199 | A | 2/1996 | Shimoyama | |
| 5,515,944 | A | 5/1996 | Cappi et al. | |
| 5,560,450 | A | 10/1996 | Kouno | |
| RE35,455 | E | 2/1997 | Sakurai et al. | |
| 5,662,190 | A | 9/1997 | Abe | |
| 5,664,662 | A * | 9/1997 | Wilson et al. | 198/453 |
| 6,315,199 | B1 | 11/2001 | Ito et al. | |
| 6,471,044 | B1 * | 10/2002 | Isaacs et al. | 198/809 |
| 6,588,549 | B2 | 7/2003 | Wike, Jr. | |
| 6,978,930 | B2 * | 12/2005 | Harding et al. | 235/383 |
| 7,270,227 | B2 * | 9/2007 | Bender et al. | 198/358 |
| 2003/0115103 | A1 * | 6/2003 | Mason | 705/16 |

FOREIGN PATENT DOCUMENTS

| | | |
|---|---|---|
| EP | 531265 | 9/1992 |
| EP | 585732 | 8/1993 |
| EP | 813177 | 12/1997 |
| WO | WO03022104 | 3/2003 |

* cited by examiner

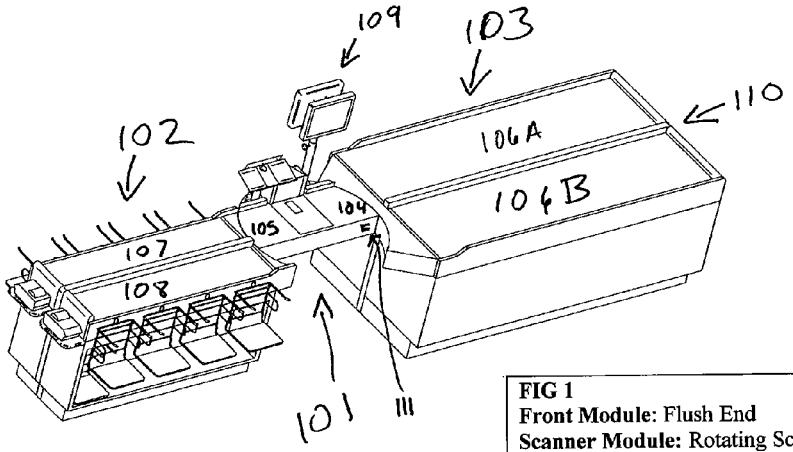

FIG 1
Front Module: Flush End
Scanner Module: Rotating Scanner
Rear Module:
*Order Processing Division:* Concurrent Orders with Flush End
*Product Transport*: Belted Conveyor
*Bag Rack Configuration*: In-Line Bagging
*Bag Rack Mounting*: Fixed Bag Racks
Other Features: Monitor Mounting

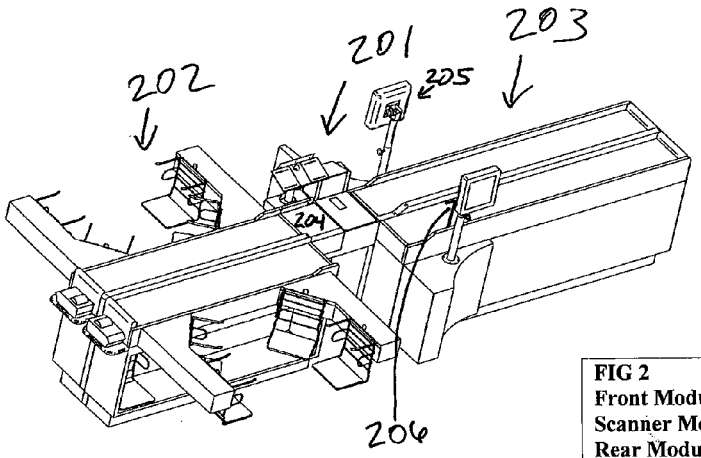

FIG 2
Front Module: Flush End
Scanner Module: Sliding Scanner
Rear Module:
*Order Processing Division:*Concurrent Orders with Flush End
*Product Transport*: Belted Conveyor
*Bag Rack Configuration*: Cockpit/Concave Bagging
*Bag Rack Mounting*: Fixed Bag Racks
Other Features: Privacy Panels

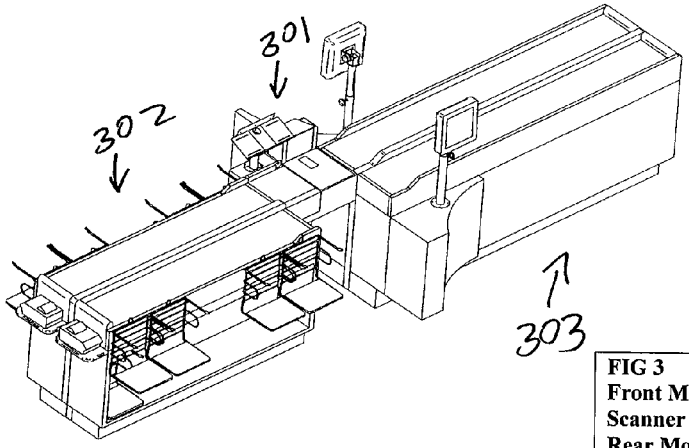

FIG 3
Front Module: Flush End
Scanner Module: Sliding Scanner
Rear Module:
*Order Processing Division:* Concurrent Orders with Flush End
*Product Transport*: Belted Conveyor
*Bag Rack Configuration*: In-Line Bagging
*Bag Rack Mounting*: Sliding Bag Racks
Other Features: Privacy Panels

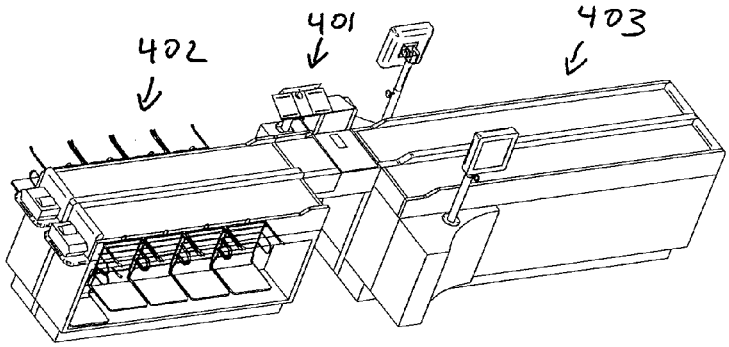

FIG 4
Front Module: Flush End
Scanner Module: Sliding Scanner
Rear Module:
*Order Processing Division:*Concurrent Orders with Flush End
*Product Transport*: Belted Conveyor
*Bag Rack Configuration*: In-Line Bagging
*Bag Rack Mounting*: Fixed Bag Racks
Other Features: Privacy Panels

Front Module: Flush End
Scanner Module: Sliding Scanner
Rear Module:
*Order Processing Division:* Concurrent Orders with Flush End
*Product Transport*: Belted Conveyor
*Bag Rack Configuration*: Cockpit/Concave Bagging
*Bag Rack Mounting*: Fixed Bag Racks
Other Features: Privacy Panels

Front Module:
Diverter Lead-In Belt
Scanner Module:
Fixed Scanner

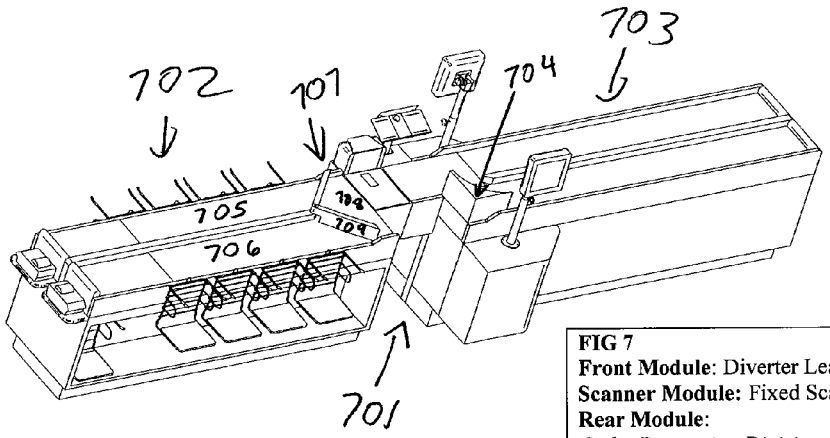

FIG 7
Front Module: Diverter Lead-In Belt
Scanner Module: Fixed Scanner
Rear Module:
*Order Processing Division:* Concurrent Orders with Lead-In Diverter
*Product Transport*: Belted Conveyor
*Bag Rack Configuration*: In-Line Bagging
*Bag Rack Mounting*: Sliding Bag Racks
*Other Rear Module Features:* Set-Aside Area
Other Features: Privacy Panels

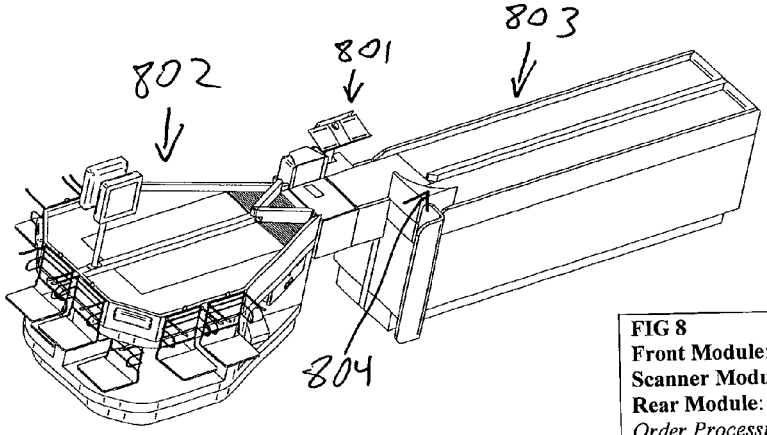

FIG 8
Front Module: Diverter Lead-In Belt
Scanner Module: Fixed Scanner
Rear Module:
*Order Processing Division:* Concurrent Orders with Lead-In Diverter
*Product Transport*: Belted Conveyor
*Bag Rack Configuration*: Convex Bagging
*Bag Rack Mounting*: Fixed Bag Racks
*Other Rear Module Features*: Set-Aside Area
Other Features: Monitor Mounting, Privacy Panels

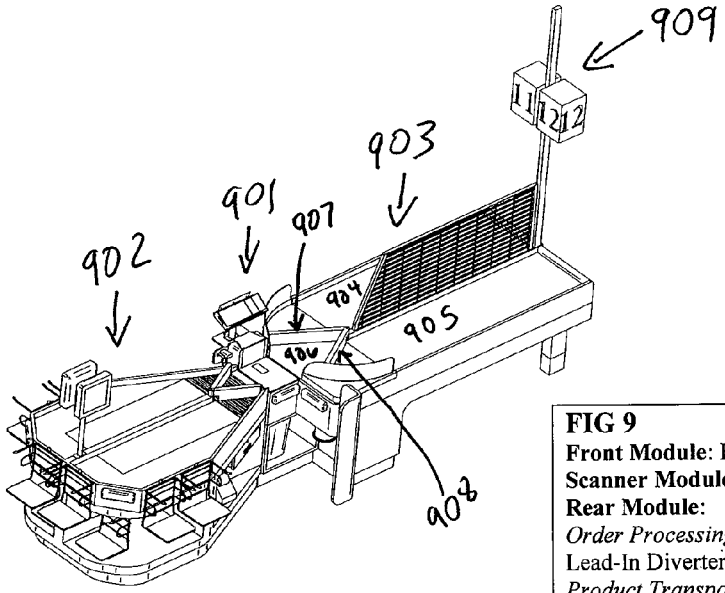

FIG 9
Front Module: Funnel Lead-In Belt
Scanner Module: Fixed Scanner
Rear Module:
*Order Processing Division:* Concurrent Orders with Lead-In Diverter
*Product Transport*: Belted Conveyor
*Bag Rack Configuration*: Convex Bagging
*Bag Rack Mounting*: Fixed Bag Racks
*Other Rear Module Features:* Set-Aside Area
Other Features: Monitor Mounting, Privacy Panels

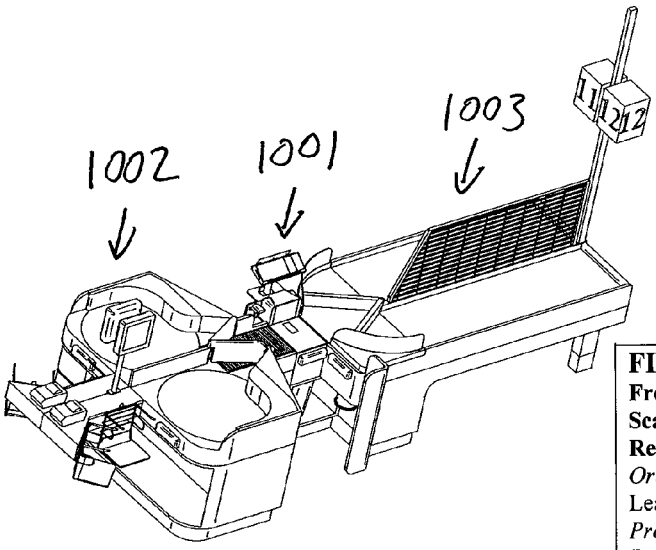

FIG. 10
Front Module: Funnel Lead-In Belt
Scanner Module: Fixed Scanner
Rear Module:
*Order Processing Division:* Concurrent Orders with Lead-In Diverter
*Product Transport*: Turntables
*Bag Rack Configuration*: Cockpit/Concave Bagging
*Bag Rack Mounting*: Fixed Bag Racks
Other Features: Monitor Mounting Privacy Panels

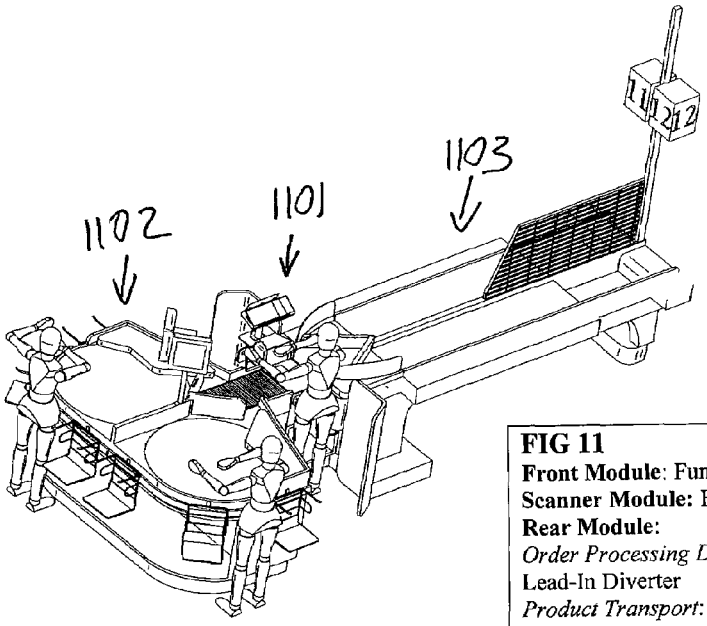

FIG 11
Front Module: Funnel Lead-In Belt
Scanner Module: Fixed Scanner
Rear Module:
*Order Processing Division:* Concurrent Orders with Lead-In Diverter
*Product Transport*: Turntables
*Bag Rack Configuration*: Convex Bagging
*Bag Rack Mounting*: Sliding Bag Racks
Other Features: Monitor Mounting, Privacy Panels

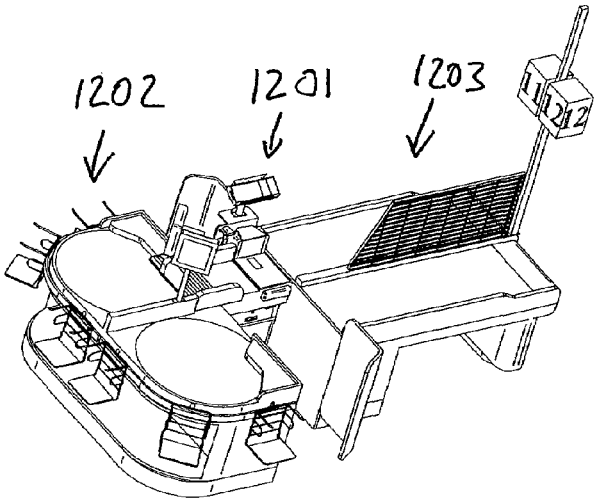

FIG. 12
Front Module: Flush End
Scanner Module: Sliding Scanner
Rear Module:
*Order Processing Division:* Concurrent Orders with Flush End
*Product Transport*: Turntables
*Bag Rack Configuration*: Convex Bagging
*Bag Rack Mounting*: Sliding Bag Racks
Other Features: Monitor Mounting, Privacy Panels

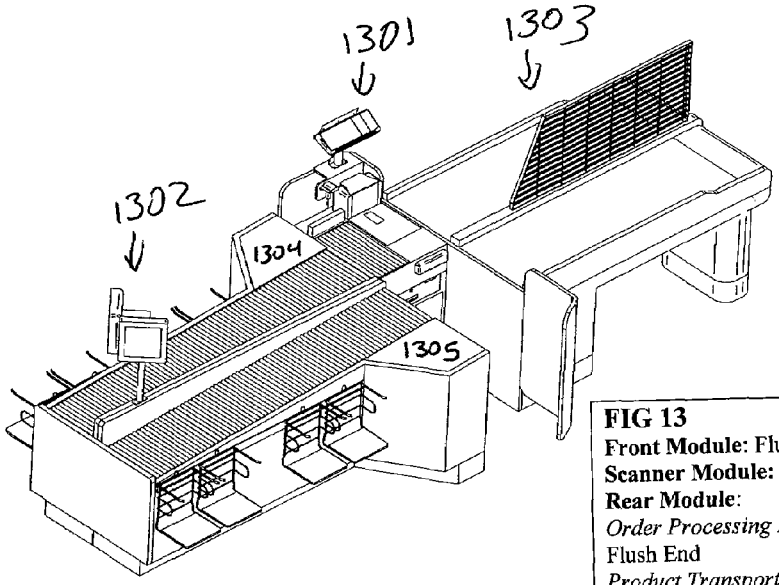

FIG 13
Front Module: Flush End
Scanner Module: Sliding Scanner
Rear Module:
*Order Processing Division:* Concurrent Orders with Flush End
*Product Transport*: Roller Conveyors
*Bag Rack Configuration*: In-Line Bagging
*Bag Rack Mounting*: Sliding Bag Racks
*Other Rear Module Features*: Set-Aside Area
Other Features: Monitor Mounting, Privacy Panels

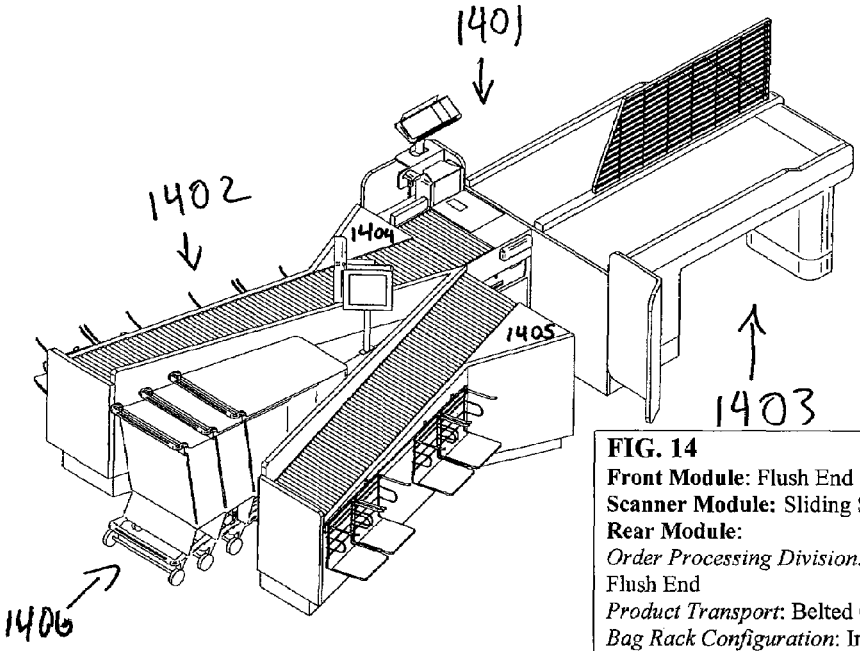

FIG. 14
Front Module: Flush End
Scanner Module: Sliding Scanner
Rear Module:
*Order Processing Division:* Concurrent Orders with Flush End
*Product Transport*: Belted Conveyor
*Bag Rack Configuration*: In-Line Bagging
*Bag Rack Mounting*: Sliding Bag Racks
*Other Rear Module Features*: Set-Aside Area, Cart Corral
Other Features: Monitor Mounting, Privacy Panels

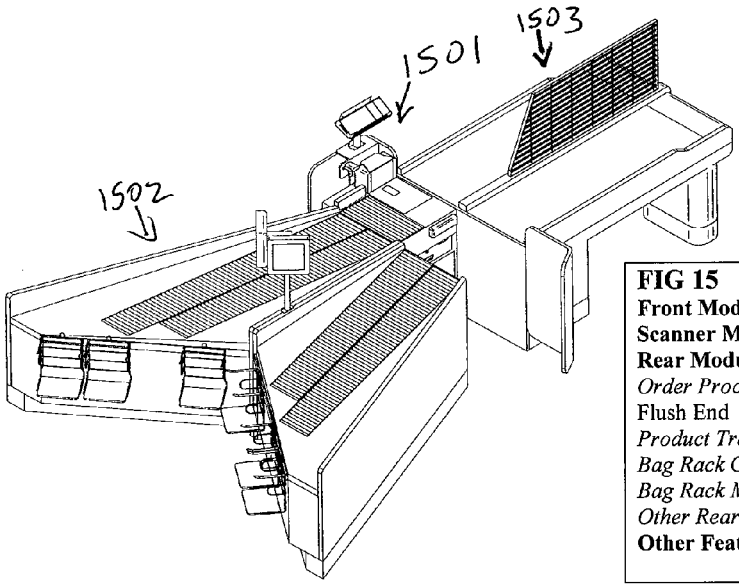

FIG 15
Front Module: Flush End
Scanner Module: Sliding Scanner
Rear Module:
*Order Processing Division:* Concurrent Orders with Flush End
*Product Transport*: Roller Conveyors
*Bag Rack Configuration*: In-Line Bagging
*Bag Rack Mounting*: Sliding Bag Racks
*Other Rear Module Features*: Set-Aside Area
Other Features: Monitor Mounting, Privacy Panels

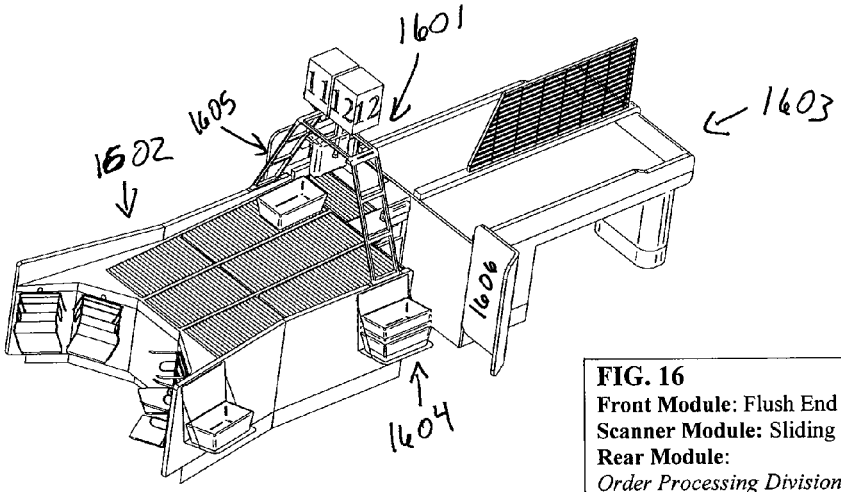

FIG. 16
Front Module: Flush End
Scanner Module: Sliding Scanner
Rear Module:
*Order Processing Division:* In-Line Orders with Fixed Divider
*Product Transport*: Roller Conveyors
*Bag Rack Configuration*: Cockpit/Concave Bagging
*Bag Rack Mounting*: Fixed Bag Racks
*Other Rear Module Features*: Set-Aside Area, Totes for Soft Goods
Other Features: Monitor Mounting, Power Arch, Privacy Panels

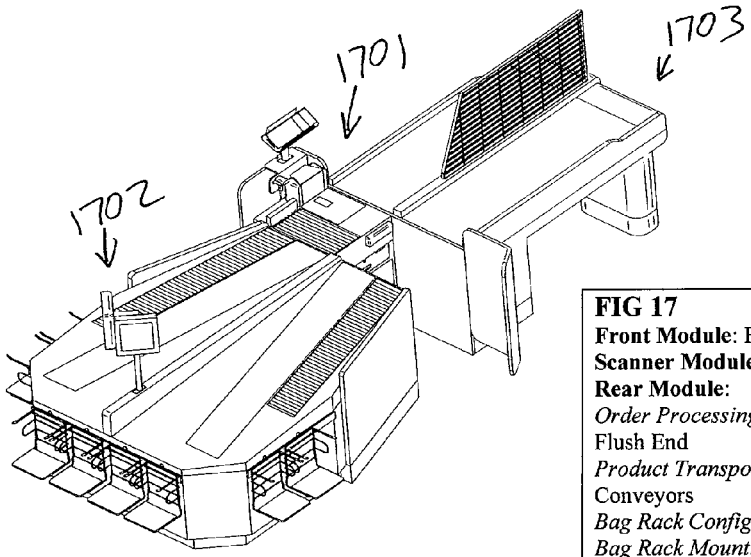

FIG 17
Front Module: Flush End
Scanner Module: Sliding Scanner
Rear Module:
*Order Processing Division:* Concurrent Orders with Flush End
*Product Transport*: Belted Conveyor, Roller Conveyors
*Bag Rack Configuration*: Convex Bagging
*Bag Rack Mounting*: Fixed Bag Racks
*Other Rear Module Features*: Set-Aside Area
Other Features: Monitor Mounting, Privacy Panels

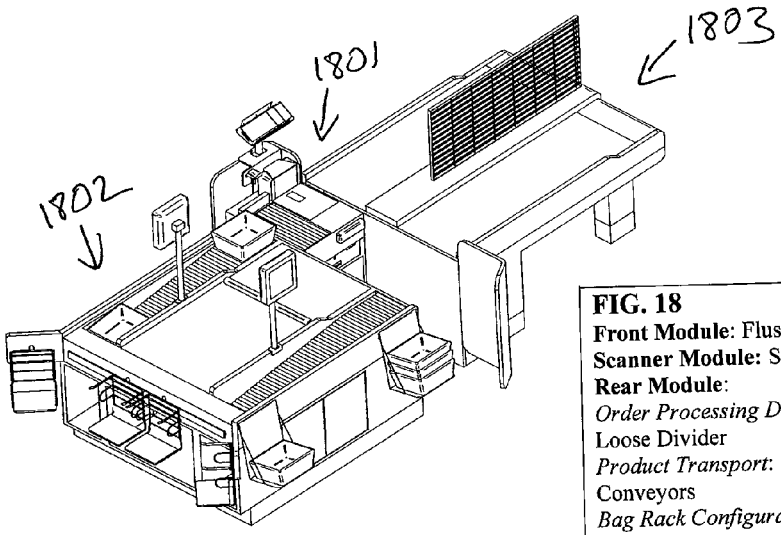

FIG. 18
Front Module: Flush End
Scanner Module: Sliding Scanner
Rear Module:
*Order Processing Division:* In-Line Orders with Loose Divider
*Product Transport*: Belted Conveyor, Roller Conveyors
*Bag Rack Configuration*: In-Line, Cockpit/Concave Bagging
*Bag Rack Mounting*: Fixed Bag Racks, Sliding Bag Racks
*Other Rear Module Features*: Set-Aside Area, Totes for Soft Goods
Other Features: Monitor Mounting, Privacy Panels

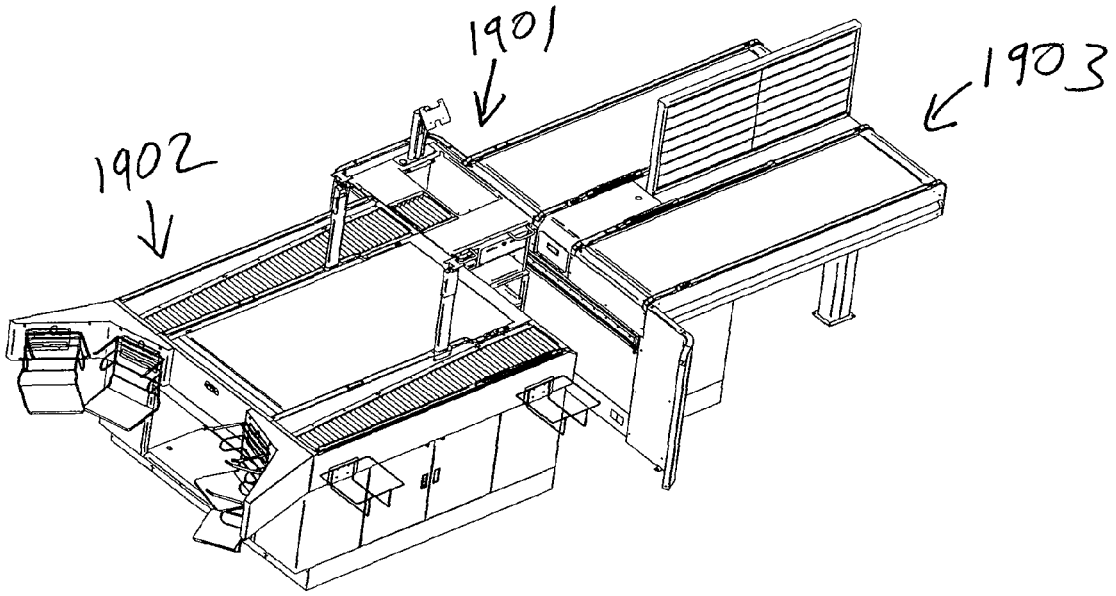

FIG 19
Front Module: Flush End
Scanner Module: Sliding Scanner
Rear Module:
*Order Processing Division:* In-Line Orders with Loose Divider
*Product Transport*: Belted Conveyor, Roller Conveyors
*Bag Rack Configuration*: Cockpit/Concave Bagging
*Bag Rack Mounting*: Fixed Bag Racks
*Other Rear Module Features*: Totes for Soft Goods
Other Features: Privacy Panels
NOTE:
This is the actual first unit produced for Meijer

CHECK STAND WITH A TWO BELTED INPUT AND A SLIDABLE SCANNER

CROSS-REFERENCE TO RELATED APPLICATION

This application claims priority to U.S. provisional application entitled, "IMPROVED CHECK STANDS," having Ser. No. 60/868,335, filed Dec. 2, 2006, which is entirely incorporated herein by reference.

This application claims priority to U.S. provisional application entitled, "FURTHER IMPROVED CHECK STANDS," having Ser. No. 60/868,795, filed Dec. 6, 2006, which is entirely incorporated herein by reference.

TECHNICAL FIELD

This invention relates to a check stand having two side-by-side belted input conveyors and a movable scanner for use with both conveyors.

BACKGROUND OF THE INVENTION

Many check stand stands used in stores have a conveyor belt that moves products placed on the belt by a customer to a scanner for checking out by a cashier. These check stands only allow one customer at a time to place products on the belted conveyor. Some stores would like this transport section of the check stand to be able to handle two customers at once to minimize the amount of time that the cashier has to wait to scan products of the customer.

As a cashier can only scan the products of a single customer at a time, it would be desirable to have a check stand that had a single scanner that could handle products from two lanes from the transport section.

SUMMARY OF THE INVENTION

This invention provides a high-volume check stand with a front transport that has two belted input conveyors so that a customer can load one belt while the cashier is checking out products purchased by a second customer on the second belt. This two belt module has a flush rear end to which is attached a scanner that can be slid from one belt to the other. Preferably this check stand has an output module which has two belts and two rollers so that the check stand can use a bagger on each side for bagging the items, to speed checkout time. Embodiments of this check stand may have an output module that is a carousel or a turntable. It could also have any combination of one or two conveyor belts and one or two rollers on an incline for use in packing the products.

A scanner is placed between the flush rear end of the front transport and the flush front end of the output module. The scanner has means for either being slid transversely or rotated by the cashier between one belted conveyor and the other conveyer so that the cashier can move from scanning products on one conveyor to the other.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 1 shows a check stand with a rotating scanner.

FIG. 2 shows a check stand with a sliding scanner.

FIG. 3 shows a check stand with a sliding scanner.

FIG. 4 shows a check stand with a sliding scanner.

FIG. 7 shows a check stand with a fixed scanner and a stationary convex lead-in diverter.

FIG. 8 shows a check stand with a fixed scanner and a stationary convex lead-in diverter.

FIG. 9 shows a check stand with a funnel convex diverter lead-in belt and a fixed scanner.

FIG. 10 shows a check stand with a funnel convex diverter lead-in belt and a fixed scanner.

FIG. 11 shows a check stand with a funnel convex diverter lead-in belt and a fixed scanner.

FIG. 12 shows a check stand with a sliding scanner.

FIG. 13 shows a check stand with a sliding scanner.

FIG. 14 shows a check stand with a sliding scanner.

FIG. 15 shows a check stand with a sliding scanner.

FIG. 16 shows a check stand with a sliding scanner.

FIG. 17 shows a check stand with a sliding scanner.

FIG. 18 shows a check stand with a sliding scanner.

FIG. 19 shows a check stand with a sliding scanner.

DETAILED DESCRIPTION OF THE PREFERRED EMBODIMENT

Figure 5:
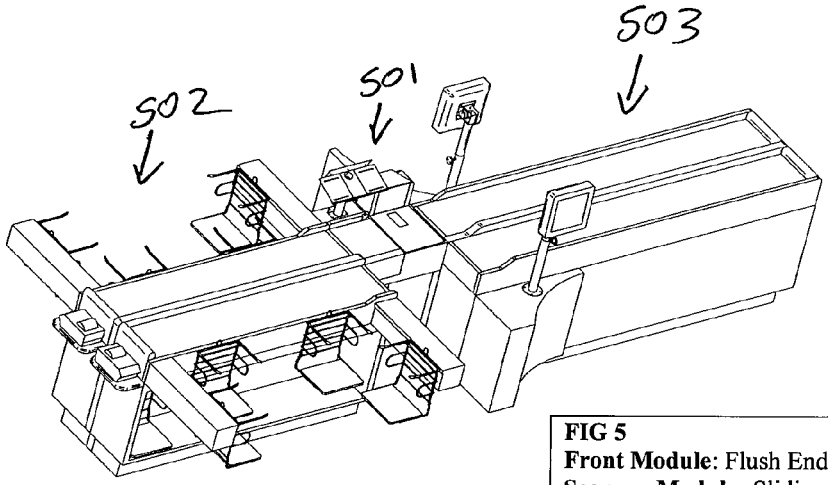
FIG. 5 shows a check stand with a sliding scanner.

An exemplary embodiment of a check stand comprises three sections: the front, or lead-in; the scanner; and the rear, also known as a take-away or bagging section. Embodiments of these sections may be seen in FIG. 1, elements 103, 101, and 102, showing a front module, scanner, and rear module, respectively.

Front Module:

The front module 103 provides space for the customer to position their purchases in preparation for scanning and order tabulation. It is comprised of two typical belted conveyor assemblies or belts 106A and 106B. The specific size of the conveyor belt is subject to the customer's needs. The belts are assembled parallel to each other, utilizing either a full-length cabinet or a small base cabinet with a pedestal end. A divider panel 110 provides privacy between the belts and can be used for product sales if desired. The specific detail for the end of the front module, which is the portion of the front module 103 that is adjacent to the scanner 101, is a function of the type of scanner module utilized. There are three possible types of end that may be used for the high-volume check stand: flush end, diverter lead-in belt, and funnel lead-in belt.

In the flush end configuration, as shown in FIG. 1 (also in FIGS. 2-5 and 12-17), both conveyor 106A and 106B belts end at the end of the unit. The end of the unit is flat and flush with rotating scanner 101. The flush style of front module is used with moving scanner modules. FIG. 2 shows a flush end front module 203 used with a sliding scanner module 201; the belts are spaced sufficiently apart as to allow the operator to pick up products from one belt without interference from products on the second belt. Photoelectric "eyes," typical of retail belted check stands, are used to control movement of the belts. Each belt functions independent of the other. When the belt is turned on, it moves forward until product placed on the belt blocks the eye. When the product is removed from the belt and the eye is clear, the belt begins to move.

Figure 6:
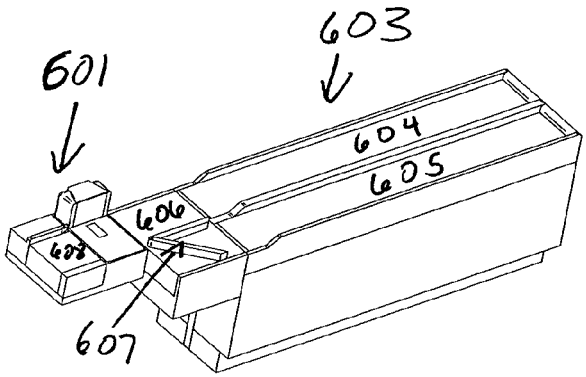
FIG. 6 shows a check stand with a diverter lead-in belt and a fixed scanner.

In a diverter lead-in belt system, as shown in FIGS. 6-8, two conveyor belts 604 and 605 feed into a third lead-in belt 606. A product diverter, either a single moving V-shaped diverter (FIG. 6, element 607) or a stationary convex diverter (FIG. 7, element 704), is utilized to move the product transversely on the lead-in belt to align the product with the scanner. This style of front module is used with fixed scanners 601 and 701, as the fixed scanner is aligned with one side of the front module. Photoelectric "eyes," typical of retail belted check stands, are used to control movement of the belts. Electronic control is used to identify the active belt (the belt containing the customer's order that is currently being scanned) and the queue belt (the belt containing the next customer's order to be scanned). Product placed on the queue belt moves forward until the eye, located at the end of the conveyor belt but before the lead-in belt, is blocked. Product placed on the active belt moves forward from the conveyor belt onto the lead-in belt and then moves forward on the lead-in belt until the eye, located at the end of the lead-in belt, is blocked. When the operator removes product from the lead-in belt and the eye is clear, the belt begins to move. The operator specifies which belt is to be the active belt and which belt is to be the queue belt, either with a manual switch or with control in the point-of-sale (POS) software.

A funnel lead-in belt, as shown in FIGS. 9-11, has two conveyor belts 904 and 905 that end and feed into a third lead-in belt 906. The lead-in belt is the full width of the entire front module. Funnel convex diverters 907 and 908 use a movable V-shaped diverter to move the product transversely on the lead-in belt to align the product with the scanner. This style of front module is used with fixed scanners, as the scanner is aligned in the center of the front module. Photoelectric "eyes," typical of retail belted check stands, are used to control movement of the belt. Electronic control is used to identify the active belt (the belt containing the customer's order that is currently being scanned) and the queue belt (the belt containing the next customer's order to be scanned). Product placed on the queue belt moves forward until the eye, located at the end of the conveyor belt but before the lead-in belt, is blocked. Product placed on the active belt moves forward from the conveyor belt onto the lead-in belt and then moves forward on the lead-in belt until the eye, located at the end of the lead-in belt, is blocked. When the operator removes product from the lead-in belt and the eye is clear, the belt begins to move. The operator specifies which belt is to be the active belt and which belt is to be the queue belt, either with a manual switch or with control in the point-of-sale (POS) software.

Scanner Module:

The scanner module houses all of the electronics and other equipment necessary to complete the scanning and totaling of a customer's purchases. This includes, but is not limited to: an optical scanner, coupon drawer, receipt printer, hand-held optical scanner, Point of Sale (POS) computer, data-entry keyboard, cash drawer, and electronic-funds-transfer (EFT) terminal. The scanner may either be a rotating scanner, a sliding scanner, or a fixed scanner.

A rotating scanner, as shown in FIG. 1, element 101, is configured such that the scanner and all of the equipment are mounted in a chassis that can rotate 180 degrees around from one side of the check stand to the other. The rotation is accomplished through a series of bearings or casters. The moving section has positive locks to align and position it relative to the front and rear modules. The scanner has a lead-in area 104 and a take-away area 105 to facilitate movement of the product from the front module to the scanner and from the scanner to the rear module, respectively. These lead-in and take-away areas are comprised of small conveyor bells, roller conveyors, or stainless-steel product slides. The lead in and take away areas switch functions as the scanner rotates to align with one or the other conveyor belts. The fixed portions of the module, at the interface between the module and the front module, as well as the module and the rear module, provide mounting surfaces for the rotating portion, alignment for the entire check stand, and a path for data and electrical cabling through the entire check stand. Operationally, the rotating scanner allows the two operators of the check stand to switch between scanning and bagging functions. For the first customer order, the first operator will bag the product while the second operator scans the product. When the order is complete, the second operator unlocks the module, rotates it to the opposite side, and then locks it in place. The first operator then moves to the scanning position and the second operator moves to the bagging position.

The rotating section 101 has an engagement lock (shown as switch 111, though any appropriate locking mechanisms may be used). When a cashier finishes an order, he/she would disengage the lock and rotate the unit 180 degrees so that the scanner was on the side of the check stand. The lead-in 104 and take-away 105 sections are aligned so that the scanner 101 will align with the edges of the section regardless of which side the scanner was facing. The lane is staffed by two individuals, each assigned to a side of the lane. When a customer is on side 106A, one individual would scan the products while the second individual would bag the products for the side 106A customer. When the order is finished scanning, the first individual completes the transaction with the customer, then rotates the scanner. The second individual then scans the products for the customer on side 106B, while the first individual would now bag the products for the side 106B customer. The rotation is restricted to 180 degrees from one side to another; it would not freely spin 360 degrees around. This would allow cabling to be routed to the scanner, and also any associated switches or power equipment. There is a base cabinet under the rotating section that would be anchored to the floor and provide support for the rotating portion. The use of two operators is a significant advantage of the rotating design. The operators share scanning and bagging responsibilities, depending on which side the customer is on. This gives a good balance of workload on the lane, and breaks up the monotony of the job. It also allows the customer to be face-to-face with the employee who is scanning their products.

In a sliding scanner configuration, as shown in FIGS. 2-5 and 12-17, the scanner 201 and all of the equipment are mounted in a chassis that translates from one side of the check stand to the other. The translation is accomplished through the use of heavy-duty equipment or drawer slides mounted between the chassis and the front and rear modules. It can also be accomplished by using rollers mounted to the chassis and guide rails mounted to the front and rear module. The moving section 201 has positive locks to align and position the scanner in line with one conveyor belt on the front module or the other. The scanner has a take-away area 204 to facilitate movement of the product from the scanner to the rear module, since the width of the scanner module must be large enough to allow an operator room to stand between the front and rear modules. This take-away area 204 is comprised of a small conveyor belt, roller conveyor, or stainless-steel product slide. The fixed portion of the module provides alignment for the entire check stand and a path for data and electrical cabling through the entire check stand. Alternatively, the entire scanner module can be a single chassis that translates between the two conveyor belts, with only a small base frame to provide the alignment and cabling path. This translation can be accomplished by using non-swivel casters or a rail-and-guide-wheel assembly, where the rails are mounted to the base frame and the chassis, with guide wheels attached, rolls back and forth on the rails. The sliding scanner works best with the front module that includes the flush end, as shown in FIG. 2, though other configurations are possible.

A fixed scanner, as shown in FIGS. 6-11, has the scanner 601 and all of the equipment mounted in a single cabinet that is fixed in place between the front module and the rear module. The scanner has a take-away area 608 to facilitate movement of the product from the scanner to the rear module, since the width of the scanner module must be large enough to allow an operator room to stand between the front and rear modules. This take-away area 608 is comprised of a small conveyor belt, roller conveyor, or stainless-steel product slide. The cabinet provides alignment for the entire check stand and a path for data and electrical cabling through the entire check stand. The fixed scanner can be used with either of the lead-in belt front modules.

Rear Module:

The rear module is a workspace for placing customer purchases into shopping bags. A number of elements are combined to identify a variety of configurations of the entire module. The rear module provides storage for additional bag racks, additional inventory of shopping bags, and other needs. Depending on the retailer's electronics package, the receipt printer(s) may or may not be mounted in the rear module. Four different configurations may be used for order division and processing; these are discussed below.

For concurrent orders with a flush end, as shown in FIGS. 1-5, 12-15, and 17, the rear module 102 is divided into two halves 107 and 108 so that the first customer order can be scanned and bagged on one side 107 of the rear module, and then the second customer order can be scanned and bagged on the other side 108 of the rear module while the first order is still being bagged. When staffed with two bagging operators, two customer orders can be bagged simultaneously. The flush front end of the module accommodates a moving scanner module than will transverse between the two sides of the rear module. This option may be used with either the rotating 101 or sliding 201 scanner modules.

Concurrent orders with a lead-in diverter, as shown in FIGS. 7-11, requires that the rear module be divided into two halves 705 and 706 so that the first customer order can be scanned and bagged on one side 705 of the rear module, and then the second customer order can be scanned and bagged on the other side 706 of the rear module while the first order is still being bagged. When staffed with two bagging operators, two customer orders can be bagged simultaneously. The lead-in diverter 707 accommodates a fixed scanner module and is comprised of a short take-away section 708 from the scanner and a rotating diverter arm 709. The short take-away section 708 can be a small conveyor belt, roller conveyor, or stainless-steel product slide. The scanner operator specifies which side of the rear module is to be used for the customer order to be scanned, either with a manual switch of the diverter arm or with control in the point-of-sale (POS) software. This option may be used with the fixed scanner module 701.

For in-line orders with a fixed divider, as shown in FIG. 16, the rear module 1602 is wide enough to accommodate any configuration of scanner module. If desired, separate paths for soft goods (e.g. bread, eggs, and clothing) may be used in addition to a main path for durable goods. As product is scanned and passed to the rear module, it moves towards the bagging end. Once the first order is complete and has passed the divider point, the scanner operator activates the fixed divider to separate the first order from the second order. The scanner operator then begins scanning the second order. Once the bagging operator has completed bagging the first customer order, the operator deactivates the fixed divider, and the second customer order begins to move towards the bagging end. The fixed divider is a panel that is tall enough to block the path of product without allowing product to fall over the divider. It is wide enough to block the entire path of travel of the customer order. The divider may be activated by a mechanical lever, electric linear actuator, pneumatic cylinder, or other mechanism. The divider may travel vertically from the plane of the rear deck or may be a flat section of the rear deck that rotates about a pivot axis from horizontal to vertical. Both the scanner and bagging operators have controls to allow activation and deactivation of the divider. This option can be used with any type of scanner module.

For in-line orders with a loose divider, as shown in FIGS. 18-19, the rear module 1802 is wide enough to accommodate any configuration of scanner module. If desired, separate paths for soft goods (e.g. bread, eggs, and clothing) may be used in addition to a main path for durable goods. As product is scanned and passed to the rear module, it moves towards the bagging end. Once the first order is completed, the scanner operator places the loose divider on the rear module to separate the first order from the second order. The scanner operator then begins scanning the second order. Once the bagging operator has completed bagging the first customer order, the operator removes the loose divider, places it in a track and pushes it back towards the scanner operator, and commences bagging of the second customer order. The loose divider is a part that is unique and different from typical customer purchases so as to clearly identify the division between customer orders. It is wide enough to block the entire path of travel of the customer order. The divider may be constructed of any readily available material, and may be made of extruded or machined plastic, extruded aluminum or metal shape (e.g. square tube, rectangular tube, angle iron, etc.), or formed sheet metal. This option can be used with any type of scanner module.

Three product transport configurations may be used in the front and rear module, and as the lead-in and take-away portions of the scanner: belted conveyor, roller conveyors, or turntables. In a belted conveyor system, as shown in FIGS. 1-9, 14, and 17-19, product is moved from the scanner end of the rear module to the bagging end of the rear module by a belted conveyor assembly typical of those used in commercial check stands. The assembly includes a motorized roller, idler and guide rollers, and housing. Exact size of the belt is determined by the configuration of the rear module specifically and the overall check stand as a whole unit. Roller conveyors, as shown in FIGS. 13 and 15-19, move products from the scanner end of the rear module to the bagging end of the rear module by a series of rollers mounted in a pan or other housing. The rollers are free spinning, and can be constructed of plastic or metal tubing with an axle through the middle of the roller. A substantial portion of the rollers, if not all of them, are mounted on an inclined slope such that the force of gravity aids in moving the product downhill from the scanner operator to the bagging operator. When roller conveyors are used for soft goods, where a tote or other bin will be utilized, it may be desirable to have a short portion of the roller conveyor position flat horizontal to facilitate loading of the tote or bin. Once the tote or bin is loaded with product, the scanner operator gently pushes the tote from the horizontal section onto the angled section, and the force of gravity aids in moving the tote along the roller conveyor to the bagging operator. Lastly, a turntable, as shown in FIGS. 10-12, elements 1002, 1102, and 1202, is a large, round, flat, rotating surface. The turntable rotates in such a manner as to allow product to move away from the scanner operator when the product is moved from the scanner to the turntable. The size of the turntable is determined by the overall desired footprint of the check stand, as well as the desired capacity for a typical customer order size. The turntable is mounted inside a cabinet, and the cabinet features a small, curved diverter that functions to push product from the outer edge of the turntable towards the center of the turntable. This creates a clear area around the perimeter of the turntable to allow the scanner operator space to place products after scanning, as well as to increase the amount of usable surface of the turntable for accumulating product. The bagging operator can selectively choose product from the accumulated product on the turntable to facilitate bagging of similar or like items, while leaving other product for later bagging. The turntable may be constructed of any typical flat material (e.g. wood, sheet metal, or plastic) and is mounted in a cabinet with sufficient bearing or bearing surfaces to facilitate easy rotation. Powering means for the turntable, such as a direct-drive motor, gear motor, or motor-belt-pulley assembly, provides the rotation. Additional support for the turntable may be provided by casters or other bearings. The top surface of the turntable must be durable and able to withstand sliding product.

The bag rack configuration is part of the rear module; it may be in-line, cockpit/concave, or convex. In-line bagging, as shown in FIGS. 1, 3-4, 7, 13-15, and 18, has the bag racks mounted on a single plane. The racks may be mounted directly to the cabinet or hung from bag-rack brackets. Cockpit or concave bagging, as shown in FIGS. 2, 5, 10, 16, 18, and 19, has bag racks that are mounted on a concave plane such that the bagging operator can have the bag racks positioned around him or herself in a curved fashion. The racks may be mounted directly to the cabinet or hung from bag-rack brackets. For convex bagging, as shown in FIGS. 8-9, 11-12, and 17, bag racks are mounted on a convex plane around the rear module, such that the bagging operator can be positioned at different places around the rear module and have ready access to bag racks. The racks may be mounted directly or hung from bag-rack brackets.

The bag racks may be mounted in either a fixed or sliding manner. Fixed bag racks, as shown in FIGS. 1-2, 4-5, 8-10, and 16-19 are mounted directly to the cabinet or hung from bag rack brackets. The mounting position of the bag rack is such that it is fixed relative to cabinet. The bag rack may be removable or permanently attached. Sliding bag racks, as shown in FIGS. 3, 7, 11-15, and 18, have a horizontal rail mounted to the rear module. Attached to the rail are adapters which can travel along the length of the rail. The adapters may be locked in place and moved along the rail after unlocking, or may freely travel along the rail. The adapters may have rollers or other types of bearings to facilitate easy movement, or may have bearing surfaces to accomplish such. Bag racks are mounted directly to the adapters or hung from bag rack brackets that are mounted to the adapters. The bag rack may be removable or permanently attached.

The rear module may have several additional features. There may be a set-aside area for soft goods (e.g. bread, eggs, and clothing) or for product that needs to be removed from the product transport area but is not ready to be bagged, as shown in FIGS. 13-14, elements 1304-1305 and 1404-1405. The size of the area is a function of the overall footprint of the check stand, or to meet customer needs. The top surface of the set-aside area must be durable and able to withstand sliding product. The set-aside area may be located at the front of the rear module (near the scanner operator), at the end of the rear module, or along the sides of the product transport. A cart corral 1406 may be provided to facilitate storage of additional shopping carts near the check stand, the check stand being constructed such that there is a designated, protected area for shopping cart storage. The area is sized to accommodate standard shopping carts, and features durable materials and guards to protect the check stand and carts. Totes for soft goods may also be provided, as shown in FIG. 16, element 1604, as some products may be perishable or fragile, necessitating separation of these items ("soft goods") from the remainder of the customer order. Soft goods may include, but are not limited to, bread, eggs, or clothing, totes or bins are provided to serve as an accumulation and transport method for the soft goods. The totes are light enough to be easily handled by the scanner and bagging operators, while being durable enough to protect the soft goods and withstand many uses throughout the life of the check stand. Storage racks for the totes are provided in locations adjacent to the scanner module, for access by the scanner operator, and the back end of the rear module, for access by the bagging operator. Totes or bins may be made of durable material such as plastic, light sheet metal, corrugated plastic, or rubber. For best space allocation, totes or bins stack inside each other (commonly referred to as "nesting").

Unlike traditional check stands which service customers on a single side, the high-volume check stand services customers on two sides. Therefore, it is necessary to have transaction monitors available to both sides of the check stand. This can be accomplished through the use of two individual monitor mounting posts, as shown in FIG. 2, elements 205 and 206, or through a double-sided monitor post as shown in FIG. 1, element 109. The double-sided post 109 facilitates the mounting of two monitors, while maintaining a single mounting point on the check stand as well as a single route or path for the data and power cables. The double-side mounting post consists of a hollow tube and mounting plate, as well as a mounting block on the top end of the tube. The tube and mounting block may be made with steel or other metal, or durable plastic.

In installations where power and data cables for the check stand must be routed overhead through the ceiling, it may be necessary to utilize a power connection pole, such as FIG. 9, element 909. Depending on the position of the overhead cabling, it may not be feasible to locate a single power pole in a suitable position on the check stand. A power arch (FIG. 16, element 1605) allows the cabling to come down from the ceiling to a center point on the check stand, and then route to either side of the check stand. Further, the power arch provides a central location for installing other accessories for the check stand, such as lane identification light globes, transaction monitors, and receipt printers. The power arch is constructed of strong, hollow materials such that the cabling is routed and concealed within the arch. It includes mounting plates at the bottom of each side of the arch to facilitate connection of the power arch to the check stand.

In some configurations of the check stand, particularly with the sliding scanner, portions of the scanner module, or the scanner operator, may be positioned in what would otherwise normally be the path of travel for the customer. In order to protect the equipment, operator, and customers, privacy panels (FIG. 16, element 1606) are installed to screen the equipment and direct customer traffic around the sides of the check stand. These panels are constructed of durable materials consistent with the rest of the check stand and are designed to withstand light contact from empty shopping carts and customers. They are sized to provide suitable screening for the equipment, as well as ample workspace for the scanner operator. If necessary, they can extend to and be secured to the floor.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

Therefore, having thus described the invention, at least the following is claimed:

1. A checkstand for a store where shoppers pay for their purchases, comprising:

a front transport having a front end and a rear end joined by two sides and a bottom support for resting on the floor, said front transport having two conveyor assemblies resting on the bottom support, each conveyor assembly having a conveyor belt upon which a shopper in a store places items to be purchased at the front end of the front transport for transport to the rear end of the front transport, each conveyor assembly having a motor and rollers for moving the belt from the front to the rear of the front transport, the front transport further having a switching means configured to allow an operator to designate one of the conveyor assemblies as an active belt and a second of the conveyor assemblies as a queue belt, the active belt adaptable to receive items associated with a first shopper and the queue belt adaptable to receive items associated with a second shopper;

a scanning module located adjacent to the rear end of the front transport having a scanner for scanning items taken off either of the conveyor belts on the front transport, said scanner module can be manually slid between the sides of the front transport from alignment with one conveyor belt to alignment with the other conveyor belt, and having an engagement lock to hold the scanning module in alignment with one or the other conveyor belt; and a rear module located adjacent to the scanning module to which items scanned are moved for pick-up by a shopper, said scanning module being non-rotatable and slidably attached to said front transport or said rear module such that the edge of said scanning module cannot extend beyond the outer lateral edge of either of the front transport conveyor assemblies.

2. A checkstand for a store where shoppers pay for their purchases, comprising:

a front transport having a front end and a rear end joined by two sides and a bottom support for resting on the floor, said front transport having two conveyor assemblies resting on the bottom support, each conveyor assembly having a conveyor belt upon which a shopper in a store places items to be purchased at the front end of the front transport for transport to the rear end of the front transport, each conveyor assembly having a motor and rollers for moving the belt from the front to the rear of the front transport, the front transport further having a switching means configured to allow an operator to designate one of the conveyor assemblies as an active belt and a second of the conveyor assemblies as a queue belt, the active belt adaptable to receive items associated with a first shopper and the queue belt adaptable to receive items associated with a second shopper;

a scanning module located adjacent to the rear end of the front transport having a scanner for scanning items taken off either of the conveyor belts on the front transport, said scanner being manually movable between the two conveyor belts so that the scanning module is closer to the conveyor belt-from which items are to be removed and scanned, in which the scanning module can be manually rotated so the scanning module can be brought into alignment with either of the front transport conveyor belts, and having an engagement lock to hold the scanning module in alignment with one or the other conveyor belt; and a rear module located adjacent to the scanning module to which items scanned are moved for pick-up by a shopper, said scanning module being rotatable about a fixed axis and slidably attached via curved surfaces to said front transport or said rear module.

* * * * *